United States Patent [19]

Gosse et al.

[11] Patent Number: 4,848,810

[45] Date of Patent: Jul. 18, 1989

[54] AUTOMATIC OR MANUAL OPENING DEVICE FOR THE DOOR OF A SAFETY EQUIPMENT BOX

[75] Inventors: Dominique Gosse, Nauplhle Le Chateau; Gerard Silber, Chilly-Mazarin, both of France

[73] Assignee: Societe De Fabrication D'Instruments De Mesure, Massy, France

[21] Appl. No.: 220,393

[22] Filed: Jul. 18, 1988

Related U.S. Application Data

[63] Continuation of Ser. No. 866,308, May 23, 1986, abandoned.

[30] Foreign Application Priority Data

Jan. 20, 1984 [FR] France ..... 84 00857

[51] Int. Cl.[4] ..... E05C 3/30

[52] U.S. Cl. ..... 292/129; 292/201; 292/DIG. 61

[58] Field of Search ..... 292/108, 128, 129, 201, 292/216, 218, 229, DIG. 61

[56] References Cited

U.S. PATENT DOCUMENTS

| | | | |
|---|---|---|---|
| 2,028,954 | 1/1936 | Roedding | 292/126 |
| 2,115,849 | 5/1938 | Gustonson | 235/55 |
| 3,325,203 | 6/1967 | Moler | 292/201 |
| 3,397,906 | 8/1968 | Beckman et al. | 292/129 X |
| 3,592,496 | 7/1971 | Ploughman | 292/216 |
| 3,752,519 | 8/1973 | Nordell et al. | 292/129 X |
| 3,844,593 | 10/1974 | Slattery | 292/48 |
| 4,518,179 | 5/1985 | Fenner | 292/166 |

*Primary Examiner*—Richard E. Moore

*Attorney, Agent, or Firm*—Gifford, Groh, Sheridan, Sprinkle and Dolgorukov

[57] ABSTRACT

A device for manual or automatic opening of an aircraft safety equipment box includes a pin fixed to the box door, a pivotable hook engageable with the pin, and a resilient return assembly associated with the hook. The return assembly has a main spring urging the hook to a disengaged position and a locking lever pivoted about the same axis as the hook. In its locked position the lever abuts and holds the same part of the main spring as holds the hook in its engaged position. In the release position the lever frees the main spring to drive the hook to disengage it from the pin. The return assembly further has a secondary spring for returning the lever to its release position and the hook to its engaged position. The return assembly includes a release plate locking the lever in its locked position. Displacement of the plate causes the hook to disengage from the pin.

9 Claims, 2 Drawing Sheets

AUTOMATIC OR MANUAL OPENING DEVICE FOR THE DOOR OF A SAFETY EQUIPMENT BOX

This is a continuation of co-pending application Ser. No. 866,308 filed on May 23, 1986, now abandoned.

The present invention relates to an automatic or manual opening device for the door of a safety euipment box and is intended to improve the device of the main application filed on the Jan. 18th 1985, under No. 692,911, now abandoned.

The device of the mentioned application essentially comprises:

a base plate fixed on a wall of the safety equipment box, a hook pivotingly mounted on the said base plate, the said hook being displaceable between a closed position where it maintains the door closed and an open position where it permits opening of the door, as well as a release plate mounted on the said base plate, the said release plate being on the one hand normally urged towrds an operating position where it maintains the hook in its closed position, and on the other hand displaceable towards a retracted position where the hook is displaced towards its open position.

In particular, the release plate was provided to be displaceable in translation in a direction perpendicular to the pivot axis of the hook, the said plate being nearer to this axis in its operating position than its retracted position.

Consequently, when it is wished to provide means permitting an automatic opening of the door, for example an electro-magnet, these means are mounted in the vertical axis of the locking mechanism, which causes congestion making for difficulty in mounting of the assembly in shallow safety equipment boxes.

Further, the release plate was provided with a recessed shape edged by two opposite walls extending generally parallel to the direction of translation of the said release plate; these walls providing both a direct abutment for the main spring associated with the hook, and an indirect abutment for the secondary spring associated with a locking lever normally fixed to the hook.

Consequently, when the automatic operating member is to cause the release plate to move from its operating position to its retacted position, it must overcome the friction from the part of the main spring against the opposite wall, which implies an extra consumption of energy, even it if is provided with a rolling element.

The present improvement has the object of improving the effectiveness of the device of the main application, in proposing a device implying a significantly lesser consumption of energy for automatic control, whilst being more compact in a manner to adapt more easily to shallow safety equipment boxes.

While the device disclosed in the prior application plainly and expressly falls within the terms of the present invention, as defined by the scope of the appended claims, the preferred embodiment of the present invention.

While the device disclosed is in the prior application plainly and expressly falls within the terms of the present invention, as defined by the scope of the appended claims, the preferred embodiment of the present invention more particularly concerns a device of the mentioned type, in which the release plate is pivotingly mounted on the base plate, about an axis parallel to that of the hook.

In accordance with a preferred embodiment, the device further comprises:

a pin fixed to the door, with which the hook can engage, a main spring mounted on an axial element fixed to the base plate and tending to urge the hook towards its open position, a locking lever pivotingly mounted close to the hook, the said locking lever being displaceable between a locking position where it holds the main spring for maintaining the hook in its closed position and a release position where it frees the main spring for driving the hook to its open position, a secondary spring mounted on the said axial element and being in contact with the locking lever and the hook, the said secondary spring thus tending to urge the said locking lever towards its release position and the said hook towards its closed position, as well as a release plate adapted to retain the locking lever in its locking position, the pivoting of the said plate towards a retracted position freeing the said locking lever so that it is driven into its release position.

Preferably, the hook and the locking lever are pivotingly mounted on a common axis, the said axis constituting the axial element about which the secondary spring is partially wound, the said secondary spring being in abutment between the said hook and the said release lever.

Advantageously, the device is remarkable in that:

the release plate has the shape of a lever comprising a main arm mounted on the pivot axis of the said plate, and secondary arm being connected to an end of the main arm and extending in a direction substantially perpendicular to this, the said secondary arm thus defining an abutment wall for a holding part of the locking lever, and that the main spring abuts on the one hand against the holding part of the release lever, behind this, and on the other hand against a cross bar fixed to the base plate, the said cross bar being arranged substantially between the common pivot axis of the hook and of the release lever and the pivot axis of the release plate.

In particular, the main arm of the release plate is extended below the pivot axis of the said plate, to be functionally connected to an automatic operating member, the said member enabling the release plate to be pivoted from its operating position to its retracted position, and a return spring is arranged between the extension of the main arm and the automatic operating member for permanently urging the release plate towards its operating position; by way of preferred example, the operating member is an electro-magnet mounted on the base plate, laterally with respect to the hook and to the release lever and on the same side with respect to the main arm of the release plate, and the electro-magnet having a plunging core of which the end has a neck received in an associated slot provided in the adajcent end of the main arm of the release plate.

Other characteristics and advantages will clearly appear in the light of the following description and accompanying drawings, relating to a preferred embodiment and with reference to the Figures in which.

Figure 1:
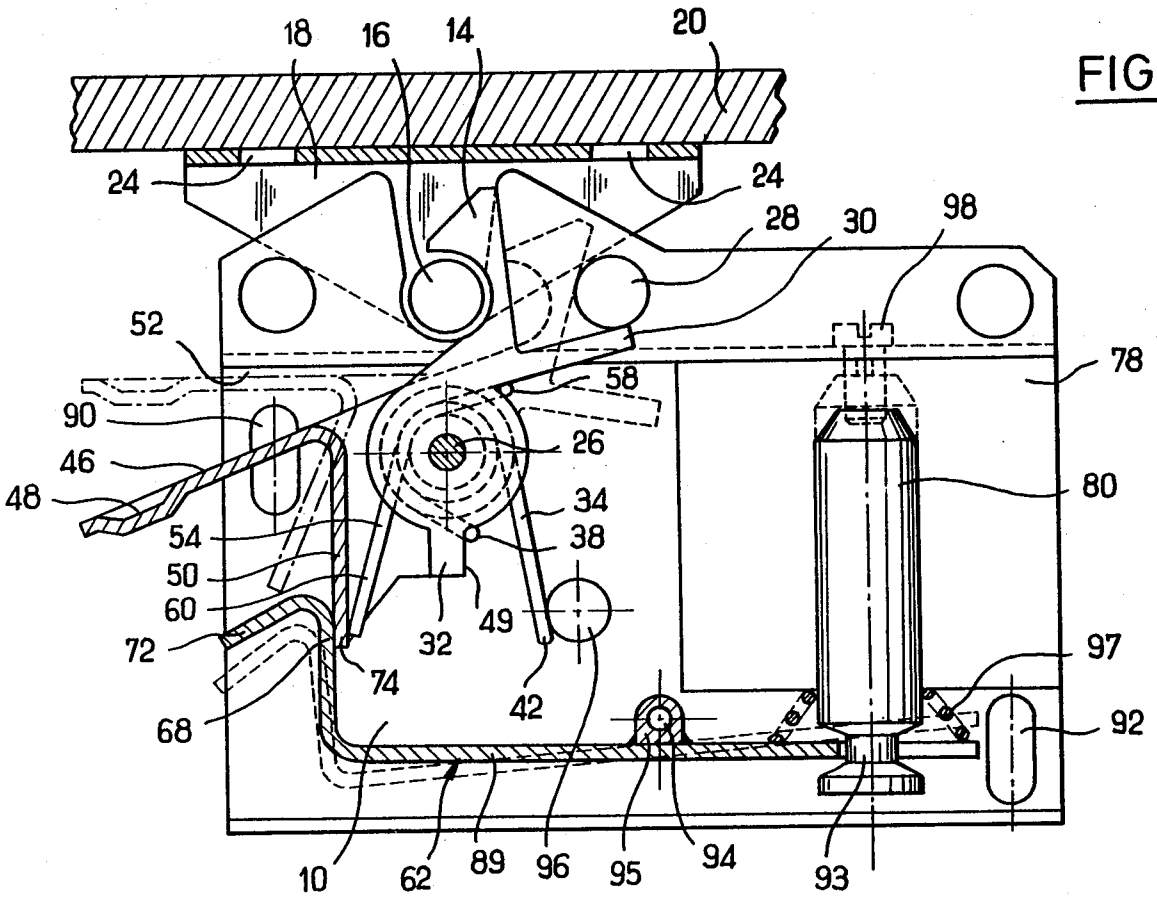
FIG. 1 is an elevation of a device according to the invention.
Figure 3:
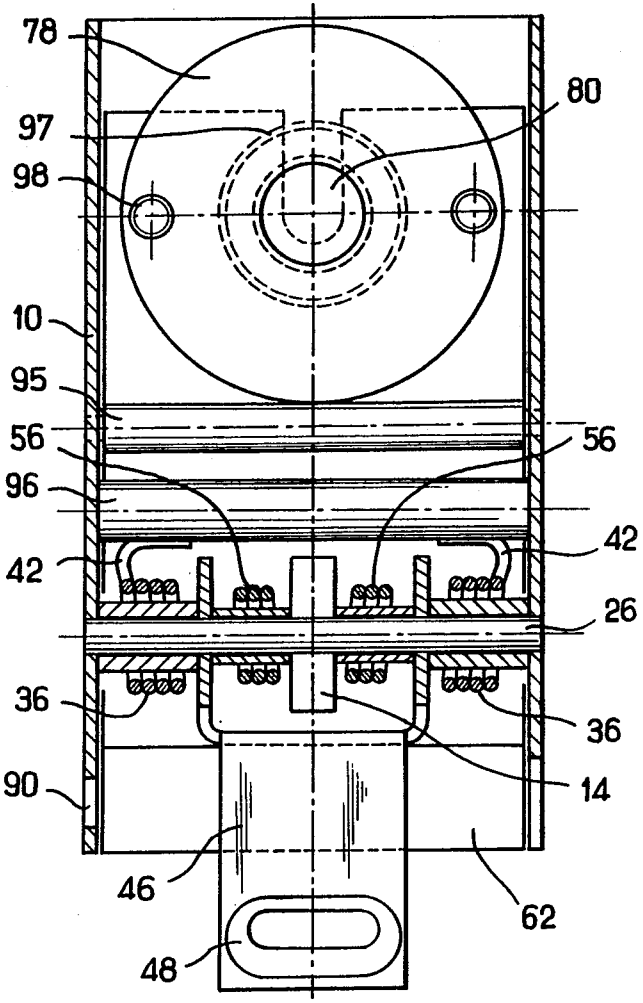
FIG. 3 is a plan view, partiallly in cross-section, of FIG. 1.

In the folloiwng description, refereneces 10 to 88 concern identical or analogous members to those of the device described and illustrated in the main application, so that only the features incorporating differences will be mentioned.

The members mounted on or about the common axis 26 are identical, that is to say:

the pivoting hook 14, with its extensions 30 and 32, the main spring 34 associated with the hook 14, with its two coils 36, its intermediary part 38 and its two free turned in ends 42, the locking lever 46, with its handle 48, its abutment wall 49 and its holding part 50, the secondary spring 54 associated with the locking lever 46, with its two coils 56, its intermediary part 58, and its two free parts 60

The essential difference resides in the structure and mounting of the release plate 62.

This is in fact made in the form of pivoting lever, having a main arm 89 and a secondary arm 68 connecting to it substantially at right angle, the said secondary arm ending in a turned in end 72. The main arm 89 carries a transverse sleeve 95, into which passes a shaft 94 fixed to the base plate 10, the said axle constituting the pivot axis for the release plate.

Because of this, unlike the plate of the main application having recessed shape, the modified plate is no longer submitted to the abutment of the ends 42 of the main spring 34, this abutment being here ensured by fixed cross bar 96 rigid with the base plate 10.

In its operating position (in continuous lines in FIG. 1), the plate 62 blocks the lever 46 in its locking position, this latter blocking the action of the main spring 34, so that the hook 14 is maintained in its closed position. The opening of the hook is unlocked by pivoting of the plate from its operating position to its retracted position (this latter is illustrated in broken lines in FIG. 1): the locking lever is in fact freed, and its displacement frees the main spring, which finally causes the displacement of the hook, the sequence of operations being the same as in the scope of the main application once the locking lever is freed.

Figure 2:
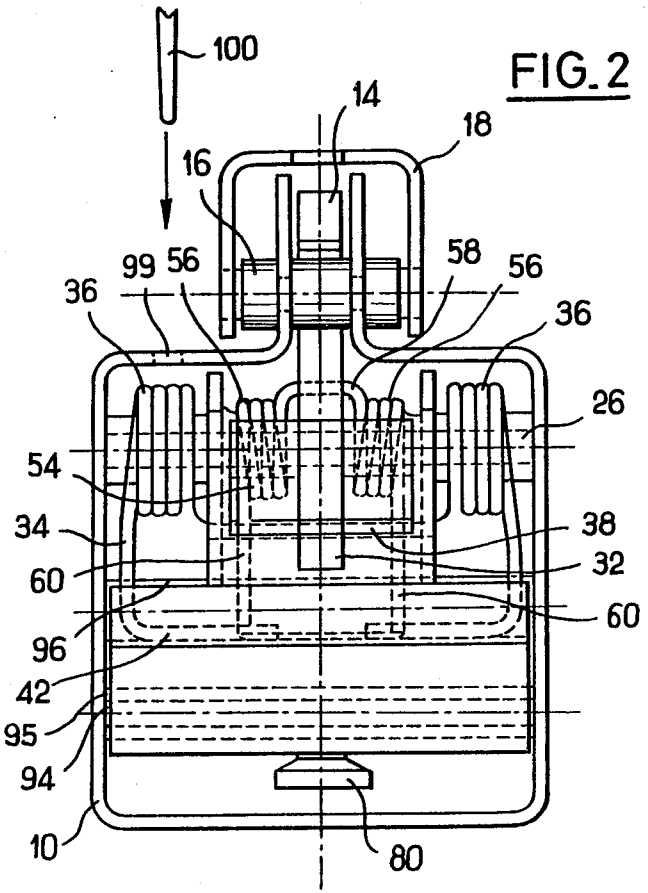
FIG. 2 is a side view of the device of FIG. 1.

The unlocking on pivoting of the release plate for its withdrawal can be obtained in two manners:

either manually, by means of a tapered object 100 (a hair pin for example) inserted through an opening 99 (shown in FIG. 2 alone) arranged for this in the base plate 10, which is much easier than an abutment on a larger extension of the end edge of the plate as was the case with the device of the main application;

or automatically, by an operating member 78, such as an electro-magnet, fixed laterally by means of a screw 98 onto the base plate 10. The plunging core 80 then has close to its end neck 93 inserted in an associated slot provided at the end of the main arm 89 of the plate, which produces the desired functional connection.

A spring 97, here concial and arranged between the operating member 78 and the main arm of the plate, exerts permanently a return force on the said plate towards its operating position.

For returning again the hook into its closed position, it is necessry to rearm the device by acting manually on the lever 46, the end 74 of the holding part 50 of the said lever sliding on the ramp 72 of the plate 62 which is automatically returned into its operatings position.

The base plate 10 is now made in a single piece, enclosing the entire system (mechanism and electro-magnet), and the assembly is fixed in the equipment box via two opposite oblong holes 90 and 92.

It should be noted that the substantially parallel disposition of the axes 26,94 and of the abutment cross bar 96 is advantageous for distributing forces, but this should not be considered as a critical arrangement for the present device.

Other modifications can be incorported in the structure which has been described:

the extension 30 of the hook 14 can be organised in a manner to abut against the cross bar 96;

the shaft 94 and the sleeve 95 can be arranged on the other side of the main arm of the plate, as can be return spring 97;

the automatic operating member can equally well be pneumatic, electro-magnetic or electric.

The improvement of the present invention brings about considerable technical advantages with respect to the device of the main application:

diminution of forces, hence significantly less energy consumption, more compact assembly, hence adapting more easily to shallow boxes, single piece base plate.

We claim:

1. Automatic or manual opening device for a door of a safety equipment box, comprising a hook pivotally mounted about an axis, said hook being formed to engage with a pin fixed to the door and being displaceable betwen a closed position where it holds the door closed, and an open position where it permits opening of the door, as well as resilient return means associated with said hook, characterised by the fact that it comprises a main spring of which one part contacts the hook for tending to return said hook towards its open position; a locking lever pivotally mounted about the axis of the hook, said lever being displaceable between a locking position where its holds the main spring by abutment contact with the same part of sid main spring to be able to hold the hook in the closed position, and a release position where it frees the main spring for driving the hook to the open position; a secondary spring partially coiled about said axis and in abutment between the spring and the locking lever for tending to return said locking lever towards its release position as well as to return said hook towrds its closed position; and a release plate having an abutment wall, said plate being urged normally towards a use position where it is adapted to hold the locking lever in the locking position by direct abutment of said lever against said wall, and being temporarily displaceable, either manually, or automtically, towards a withdrawn position for freeing the locking lever and thus driving said lever into the release position and simultaneously said hook into the open position.

2. A device according to claim 1, characterised by the fact that the release plate is translationally displaceable in a direction perpendicular to said common axis, said plate being closer to this common axis in the use position than in the withdrawn position.

3. A device according to claim 2, characterised by the fact that the release plate comprises a recessed portion which defines a base wall perpendicular to the direction of translation, as well as first wall and a second wall opposite each other, which are attached together at the base wall and which extend generally parallel to the direction of translation.

4. A device according to claim 3, characterised by the fact that the first wall is an abutment wall for a holding part of the lever, and that this abutment wall is extended beyond the recessed portion by a ramp adapted to cooperate with an end of the holding part, and by the fact that a manual actuating member is connected to the recessed portion.

5. A device according to claim 4, characterised by the fact that the manual actuating member is a handle in extension of the ramp.

6. A device according to claim 5, characterised by the fact that the lever has a handle able to be manually actuated for permitting its displacement from the release position to the locking position, the end of the holding part sliding along the ramp and penetrating into the recessed portion.

7. A device according to claim 3, characterised by the face that the second wall in an abutment wall for the main spring.

8. A device according to claim 3, characterised by the fact that the release plate is connected to an automatic actuating member provided with a cam which cooperates with the bottom of the recess for temporarily displacing the release plate from the use position to the withdrawn position, return spring being further provided for permanently returning said plate towards its use position.

9. A device according to claim 8, characterised by the fact that the automatic actuating member is an aneroid capsule.

* * * * *

UNITED STATES PATENT AND TRADEMARK OFFICE

CERTIFICATE OF CORRECTION

PATENT NO. : 4,848,810

DATED : July 18, 1989

INVENTOR(S) : Dominique Gosse et al

It is certified that error appears in the above-identified patent and that said Letters Patent is hereby corrected as shown below:

In the patent heading, Item [63] after "Continuation of Serial No. 866,308, May 23, 1986 abandoned" delete "." and insert --, which is a Continuation-In-Part of Serial No. 692,911, January 18, 1985, abandoned.--

Signed and Sealed this

Ninth Day of October, 1990

*Attest:*

HARRY F. MANBECK, JR.

*Attesting Officer*

*Commissioner of Patents and Trademarks*